US010954697B2

(12) United States Patent
Sugimoto et al.

(10) Patent No.: US 10,954,697 B2
(45) Date of Patent: Mar. 23, 2021

(54) HANDLE DEVICE OF VEHICLE

(71) Applicant: ALPHA CORPORATION, Kanagawa (JP)

(72) Inventors: Koichiro Sugimoto, Yokohama (JP); Takao Toyama, Yokohama (JP)

(73) Assignee: ALPHA CORPORATION, Kanagawa (JP)

( * ) Notice: Subject to any disclaimer, the term of this patent is extended or adjusted under 35 U.S.C. 154(b) by 1 day.

(21) Appl. No.: 16/397,613

(22) Filed: Apr. 29, 2019

(65) Prior Publication Data

US 2019/0249465 A1 Aug. 15, 2019

Related U.S. Application Data

(63) Continuation of application No. PCT/JP2017/040136, filed on Nov. 7, 2017.

(30) Foreign Application Priority Data

Nov. 7, 2016 (JP) ..... JP2016-217232

(51) Int. Cl.
*E05B 79/20* (2014.01)
*E05B 79/06* (2014.01)
(Continued)

(52) U.S. Cl.
CPC ..... *E05B 79/20* (2013.01); *E05B 79/06* (2013.01); *E05B 79/08* (2013.01); *E05B 79/22* (2013.01);
(Continued)

(58) Field of Classification Search
CPC ..... E05B 79/20; E05B 79/06; E05B 79/08; E05B 79/22; E05B 85/08; E05B 85/12;
(Continued)

(56) References Cited

U.S. PATENT DOCUMENTS 5,005,885 A * 4/1991 Kobayashi ..... E05B 85/12 292/336.3
5,377,450 A * 1/1995 Varajon ..... E05B 85/12 292/336.3
(Continued)

FOREIGN PATENT DOCUMENTS

CN 105074107 A 11/2015
CN 205637966 U 10/2016
(Continued)

OTHER PUBLICATIONS

Machine Translation of JP 2012097476A, 2020, pp. 1-6 (Year: 2020).*
(Continued)

*Primary Examiner* — Christine M Mills
(74) *Attorney, Agent, or Firm* — Studebaker & Brackett PC

(57) ABSTRACT

An inside handle device of a vehicle includes a handle unit and a cable unit. In the handle unit, an operation member including an operation handle is rotatably connected to a handle base. The cable unit movably holds one end of a cable device configured to connect the operation member to a latch device fixed to a door on a cable cover. The cable cover has a first locking portion formed at a cable introduction edge and a second locking portion formed at an opposite-end edge. The first locking portion is rotatably locked to the handle base with the opposite-end edge as a rotating end. The second locking portion is elastically locked in a state of being rotated around the first locking portion.

5 Claims, 9 Drawing Sheets

(51) Int. Cl.
*E05B 79/08* (2014.01)
*E05B 85/08* (2014.01)
*E05B 85/12* (2014.01)
*E05B 79/22* (2014.01)

(52) U.S. Cl.
CPC ..... *E05B 85/08* (2013.01); *E05B 85/12* (2013.01); *E05B 85/13* (2013.01)

(58) Field of Classification Search
CPC ..... E05B 85/13; E05B 79/18; Y10T 292/57; Y10S 292/53
USPC ..... 292/336.3, DIG. 53
See application file for complete search history.

(56) References Cited

U.S. PATENT DOCUMENTS

| | | | | | |
|---|---|---|---|---|---|
| 5,709,498 | A * | 1/1998 | Sova | E05B 79/12 | 403/163 |
| 5,884,434 | A | 3/1999 | Dedrich et al. | | |
| 5,934,817 | A * | 8/1999 | Kim | E05B 79/12 | 292/336.3 |
| 5,953,963 | A * | 9/1999 | Wirsing | F16C 1/12 | 403/106 |
| 6,067,874 | A * | 5/2000 | Meissner | F16C 1/26 | 403/326 |
| 6,092,436 | A * | 7/2000 | Wirsing | F16C 1/102 | 403/353 |
| 6,178,845 | B1 * | 1/2001 | Gutschner | F16C 1/105 | 74/501.5 R |
| 6,550,946 | B2 * | 4/2003 | Misawa | E05B 17/10 | 362/100 |
| 6,971,816 | B2 * | 12/2005 | Miyagawa | F16C 1/105 | 248/74.1 |
| 6,976,717 | B2 * | 12/2005 | Barr | E05B 79/06 | 292/336.3 |
| 7,175,209 | B2 * | 2/2007 | Cetnar | E05B 17/0012 | 292/100 |
| 7,597,026 | B2 * | 10/2009 | Smith | E05B 53/005 | 74/501.5 R |
| 8,408,611 | B2 * | 4/2013 | Takagai | E05B 85/13 | 292/336.3 |
| 8,616,611 | B2 * | 12/2013 | Schidan | E05B 79/06 | 296/146.7 |
| 8,864,193 | B2 * | 10/2014 | Mori | E05B 79/20 | 292/336.3 |
| 9,022,438 | B2 * | 5/2015 | Mori | E05B 79/20 | 292/336.3 |
| 9,181,734 | B2 * | 11/2015 | Minemura | E05B 79/20 | |
| 9,290,971 | B2 * | 3/2016 | Amagai | E05B 85/12 | |
| 10,087,657 | B2 * | 10/2018 | Uemura | E05B 79/20 | |
| 10,107,017 | B2 * | 10/2018 | An | E05B 79/06 | |
| 10,119,307 | B2 * | 11/2018 | Sugimoto | E05B 79/08 | |
| 10,196,838 | B2 * | 2/2019 | Nagaoka | E05B 79/20 | |
| 10,458,161 | B2 * | 10/2019 | Kunimatsu | E05B 79/06 | |
| 2009/0144940 | A1 * | 6/2009 | Yamada | B60R 13/0243 | 16/412 |
| 2014/0070070 | A1 | 3/2014 | Shinoda | | |
| 2015/0323100 | A1 | 11/2015 | Shinoda | | |
| 2016/0001643 | A1 | 1/2016 | Ichikawa | | |
| 2017/0037663 | A1 | 2/2017 | Sugimoto | | |
| 2019/0017300 | A1 * | 1/2019 | Amagai | E05B 53/005 | |
| 2019/0249464 | A1 | 8/2019 | Sugimoto et al. | | |
| 2020/0080347 | A1 * | 3/2020 | Kin | B60J 5/00 | |
| 2020/0080352 | A1 * | 3/2020 | Kin | E05B 85/13 | |

FOREIGN PATENT DOCUMENTS

| | | | | | |
|---|---|---|---|---|---|
| CN | 109863279 | A | 6/2019 | | |
| DE | 198 37 662 | A1 | 4/1999 | | |
| EP | 3 536 883 | A1 | 9/2019 | | |
| FR | 2876077 | A1 * | 4/2006 | E05B 79/06 | |
| JP | S47-44691 | B2 | 11/1972 | | |
| JP | 2000087600 | A * | 3/2000 | E05B 85/12 | |
| JP | 2012-097476 | A | 5/2012 | | |
| JP | 2014-047839 | A | 3/2014 | | |
| KR | 20070025706 | A * | 3/2007 | | |
| WO | WO-9600339 | A1 * | 1/1996 | E05B 85/12 | |
| WO | 2015-163385 | A1 | 10/2015 | | |
| WO | WO-2019151457 | A1 * | 8/2019 | E05B 85/12 | |
| WO | WO-2019240265 | A1 * | 12/2019 | E05B 85/12 | |

OTHER PUBLICATIONS

Machine Translation of DE 19837662A1, 2020, pp. 1-10 (Year: 2020).*

An Office Action mailed by he State Intellectual Property Office of the People's Republic of China dated Jun. 3, 2020, which corresponds to Chinese Patent Application No. 201780068379.1 and is related to U.S. Appl. No. 16/397,613; with English language translation.

Extended European Search Report issued in EP 17 868 098.9 by the European Patent Office dated May 18, 2020, which is related to U.S. Appl. No. 16/397,613.

International Search Report issued in PCT/JP2017/040136; dated Jan. 30, 2018.

Written Opinion issued in PCT/JP2017/040136; dated Jan. 30, 2018.

Office Action issued in JP 2016-217232; mailed by the Japanese Patent Office dated Jan. 20, 2021.

* cited by examiner

HANDLE DEVICE OF VEHICLE

CROSS REFERENCE TO RELATED APPLICATIONS

This application is a continuation of PCT application No. PCT/JP2017/040136, which was filed on Nov. 7, 2017 based on Japanese Patent Application No. 2016-217232 filed on Nov. 7, 2016, the contents of which are incorporated herein by reference.

TECHNICAL FIELD

The present invention relates to an inside handle device of a vehicle.

BACKGROUND ART

Patent Literature 1(: JP-A-2012-97476) discloses an inside handle device of a vehicle mounted on a door of the vehicle.

In the inside handle device disclosed in Patent Literature 1, a lock knob and an inner door handle are rotatably connected to a handle base. The lock knob is provided with a locking portion, and the inner door handle is provided with a handle side locking portion. Tip ends of an inner cable of the cable device is locked to the locking portion and the handle side locking portion, and a rotational operation force to the lock knob or the like is transmitted to a latch and lock portion via the inner cable.

CITATION LIST

[Patent Literature 1] JP-A-2012-97476

In the inside handle device of Patent Literature 1, locking of the inner cable with the locking portion or the handle side locking portion needs to be performed in a state in which it is possible to prevent disengagement during operation of an operation portion, thereby causing a problem of deteriorated engagement operability and poor assembly operability.

According to an embodiment of this disclosure, in an inside handle device of a vehicle, connection operability of a cable device can be improved.

According to an embodiment of the invention, an inside handle device of a vehicle includes a handle unit and a cable unit. In the handle unit, an operation member including an operation handle is rotatably connected to a handle base. The cable unit movably holds one end of a cable device configured to connect the operation member to a latch device fixed to a door on a cable cover. The cable cover has a first locking portion formed at a cable introduction edge and a second locking portion formed at an opposite-end edge. The first locking portion is rotatably locked to the handle base with the opposite-end edge as a rotating end. The second locking portion is elastically locked in a state of being rotated around the first locking portion. The operation member is locked to a connecting body formed at the one end of the cable device in a state where the cable unit is connected to the handle unit.

In the embodiment of this disclosure, an inside handle device is formed by connecting a cable unit 8 to a handle unit 4. An operation member 3 is rotatably connected to the handle unit 4, and one end of each cable device 6 whose one end is connected to a latch device 5 is held by the cable unit 8.

In a state in which the cable unit 8 is connected to the handle unit 4, cable connection portions formed on the operation member 3 are locked to connecting bodies 11 formed at ends of the cable devices 6, and thereafter the cable devices 6, that is, the latch device 5 is actuated in accordance with the rotation operation on the operation handle 2 or the like.

Connection of the cable unit 8 to the handle unit 4 is performed by a locking first locking portions 9 provided on a cable introduction edge (a side edge on a side where cables of the cable devices 6 are drawn into a cable cover 7) of the cable cover 7, and then rotating the same with a locking position of the first locking portions 9 to the handle base 1 as a rotation center such that opposing side edges overlap each other; and since a second locking portion 10 of the cable unit 8 is elastically locked to the handle base 1 due to the rotation operation, rotation toward an initial rotational position is restricted.

When the inside handle device is fixed to a door panel 17 of a vehicle, positioning operation of the inside handle device to the door panel 17 is performed. Upon such positioning operation, when intermediate portions of the cable devices 6 are fixed to the door panel 17 by a clip or the like, or an opposite end of the cable is connected to the latch device 5 fixed to the door panel 17 in advance, a force via the cable devices 6 is applied to connecting base ends of the cable devices 6.

Since depending on a movement direction of the inside handle device, a load on the inside handle device via the cable devices 6 acts as a force that is applied to the cable unit 8, in which the cable devices 6 are directly connected, and detaches the cable unit 8 from the handle unit 4, movement operation of the inside handle device needs to be carefully performed so that an excessive load does not occur to the cable unit 8, which caused a problem of deteriorated mounting workability. Further, in order to prevent separation of the cable unit 8, it is possible to increase connection strength of the cable unit 8 to the handle unit 4, which, however, deteriorates connection operability of the cable unit 8.

On the other hand, when the inside handle device is moved toward a routing direction of the cable devices 6, which has a predetermined extra length set in advance, or is moved by the door panel 17, whose movement range is restricted, in a direction approaching the door panel 17, the force applied by the cable devices 6 is substantially based on a bending rigidity of the cable devices 6 and an excessive force is unlikely to be applied; in contrast, when the inside handle device is moved in a direction away from the door panel 17, since an operation range is not mechanically restricted, the load on the inside handle device via the cable devices 6 may increase.

On the other hand, in this disclosure in which the cable cover 7 has the opposite edge elastically locked with the cable introduction edge as the rotation center, the load in the direction in which the inside handle device is separated from the door panel 17, that is, the load in the direction in which the cable devices 6 are pushed toward the door panel 17, which has a high probability of occurrence of an excessive load, is applied with a rotational operation force in the direction in which the second locking portion 10 is pressed against the handle base 1 with the first locking portions 9 as the rotation center.

Since the rotational operation force is opposite to an unlocking direction of the first locking portion 9, detachment of the cable unit 8 due to the attachment operation of the inside handle device is effectively prevented. As a result, workability upon attachment operation of the inside handle device is improved without particularly requiring careful work for movement operation to an attachment position, and since the locking force of the second locking portion 10 does not need to increase excessively, mounting workability of the cable unit 8 is also improved.

As another embodiment of this disclosure for achieving the above object, the operation member may include a lock knob. The operation handle of the handle unit may be biased toward an initial rotational position. The lock knob and the cable cover may include a drive portion configured to contact the lock knob and to move the lock knob to a lockable position with the connecting body when connected to the cable unit.

A lock knob 12 can be connected to the handle unit 4 in addition to the operation handle 2, and the cable devices 6 are disposed to the cable unit 8 corresponding to the operation handle 2 and the lock knob 12. The connecting bodies 11 of the cable devices 6 are temporarily held at a predetermined position of the cable cover 7, and are locked to the operation handle 2 and the lock knob 12 in accordance with connection operation of the cable unit 8.

Upon connection operation of the cable unit 8, the operation handle 2 is reliably held at an initial position by a biasing force, while a rotational position of the lock knob 12, which is not provided with a biasing means to a predetermined rotational position, cannot be restricted.

A drive portion 13 formed on the cable cover 7 can improve connection reliability between the lock knob 12 and the connecting body 11 by guiding the lock knob 12 to the position of the connecting body 11 when the lock knob 12 moves along a rotation locus with the locking position to the first locking portion 9 as the rotation center in accordance with connection operation of the cable unit 8.

Temporary holding of the connecting bodies 11 can be easily achieved by, for example, providing a stopper that can be easily broken in a part of a moving path of the connecting bodies 11 of the cable cover 7, or by connecting the cable devices 6 to the latch device 5 in advance. In a state in which the latch device 5 is connected to the cable devices 6, since positions of the connecting bodies 11 are uniquely determined by the state of the latch device 5, the connecting bodies 11 can be held at predetermined positions by holding the latch device 5 in a predetermined state.

As another embodiment of this disclosure for achieving the above object, the cable cover may include a protrusion part for mark configured to be exposed to a visible position from a surface of the handle unit when connection with the handle base is completed.

In the embodiment of this disclosure, when connection between the handle unit 4 and the cable unit 8 is completed, since a protrusion part for mark 14 of the cable unit 8 is exposed on a surface of the handle base 1, an operator can confirm a mounting completion state, which enables improvement of mounting reliability.

According to an embodiment of the invention, when the inside handle device of a vehicle is configured such that the second locking portion 10 is formed in a hook shape configured to lock to a locking opening 15 provided on the handle base 1, and is exposed from the locking opening 15 of the handle base 1 to function as the protrusion part for mark 14 when the cable unit 8 is connected to the handle unit 4, it is not necessary to provide a special protrusion part for mark 14 and an opening for exposing the protrusion part for mark 14 to the surface of the handle base 1, thereby simplifying the structure.

Further, as another embodiment of this disclosure for achieving the above object, the inside handle device of a vehicle may be fixed to a door panel by a fastening bolt. The second locking portion may be restricted from moving in an unlocking direction by the fastening bolt when fixed to the door.

According to the embodiment of this disclosure, in a state in which the inside handle device is fixed to the door panel 17, a fastening bolt 16 closes a moving path of the second locking portion 10 in the unlocking direction. As a result, once the inside handle device is fixed to the door panel 17, separation between the handle unit 4 and the cable unit 8 does not occur.

According to the embodiment of this disclosure, since separation of the cable unit is unlikely to occur even when the inside handle device obtained by connecting the cable unit to the handle unit is moved when fixed to the door panel, fixing operation to the door panel can be efficiently performed without the need of excessive caution upon fixing operation.

DESCRIPTION OF EMBODIMENTS

Figure 1A:
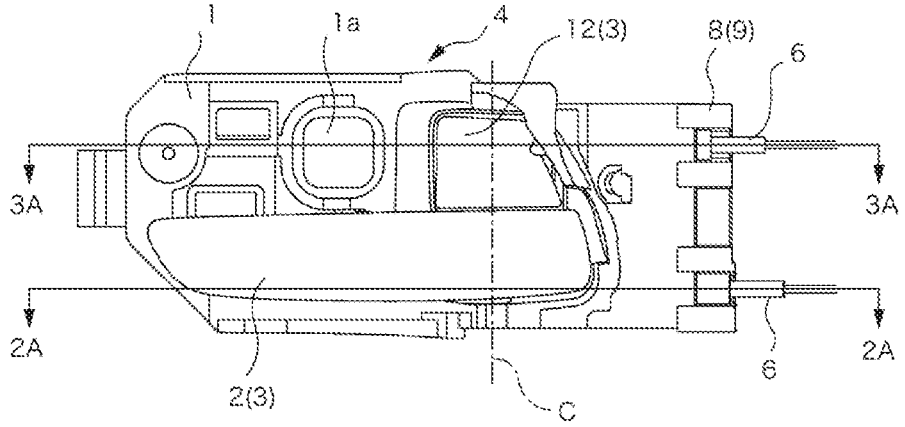
FIG. 1A is a front view of an inside handle device.
Figure 1B:
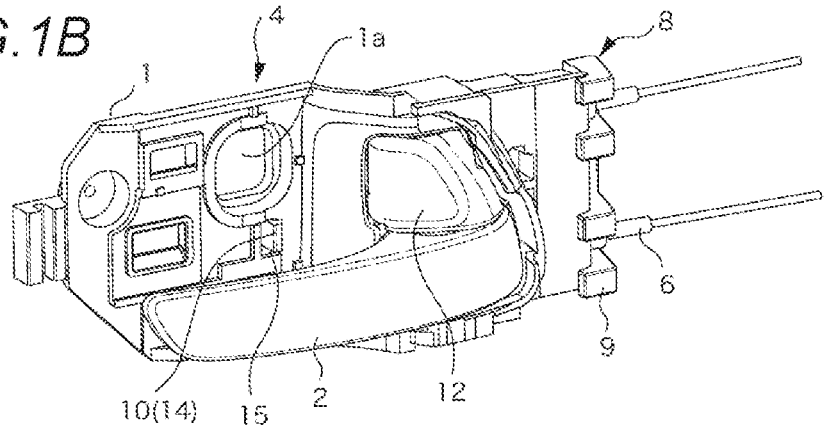
FIG. 1B is a perspective view of the inside handle device as viewed from the front.

As shown in FIGS. 1A and 1B, an inside handle device is formed by connecting a cable unit 8 to an inside surface of a handle unit 4. In the present specification, on the basis of an attachment posture to a vehicle, a left side in FIG. 1A is referred to as "front", a front side in FIG. 1A is referred to as "outside", and a rear side in FIG. 1A is referred to as "inside".

The handle unit 4 is formed by connecting the operation handle 2 and the lock knob 12 as the operation member 3 to the handle base 1 so as to be rotatable about a rotation center (C).

Figure 2:
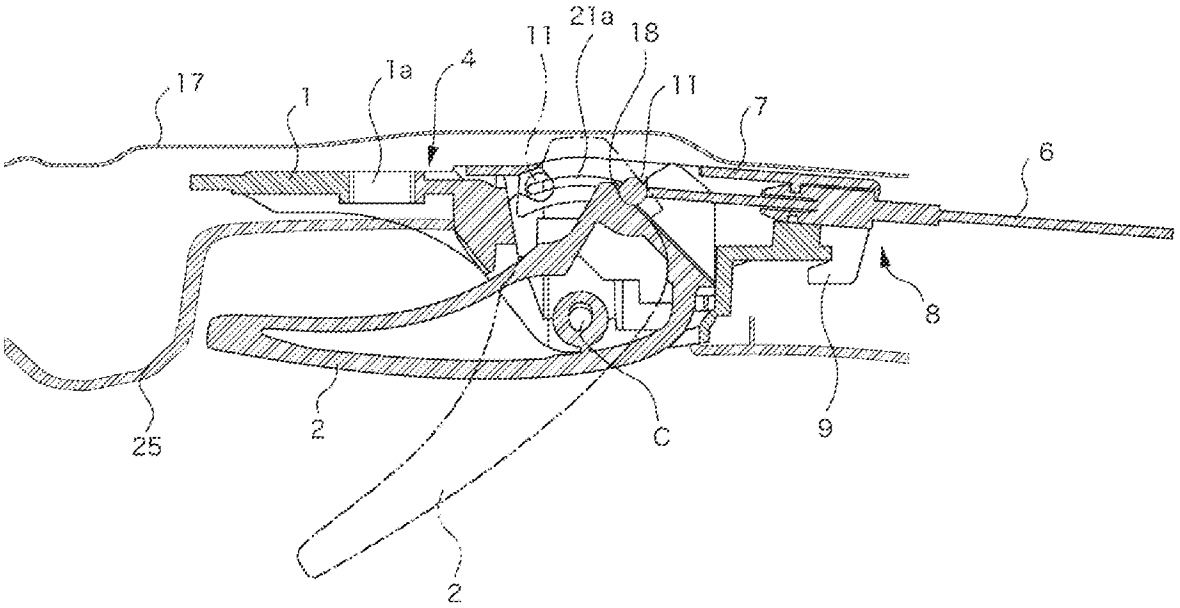
FIG. 2 is a sectional view taken along a line 2A-2A of FIG. 1A.
Figure 3:
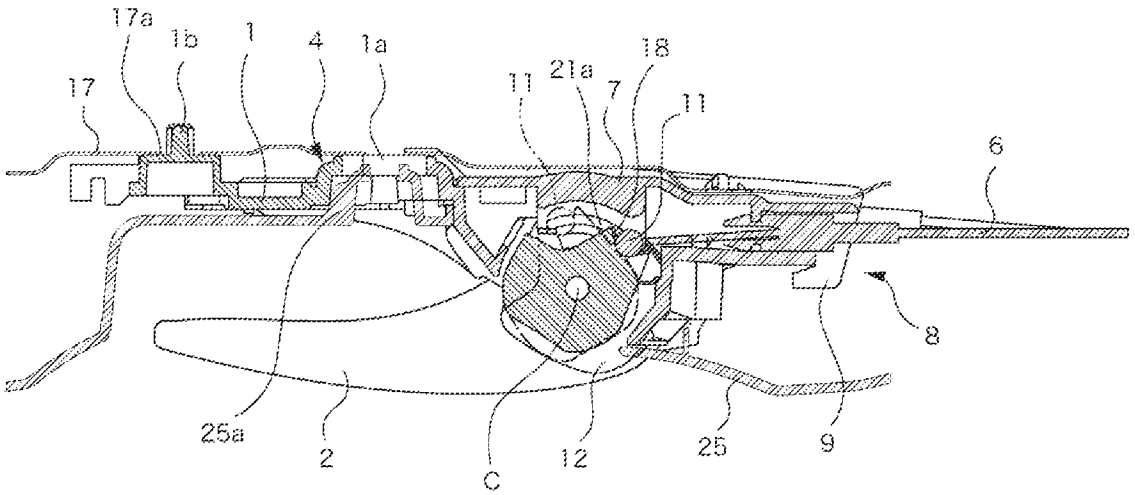
FIG. 3 is a sectional view taken along a line 3A-3A of FIG. 1A.
Figure 4A:
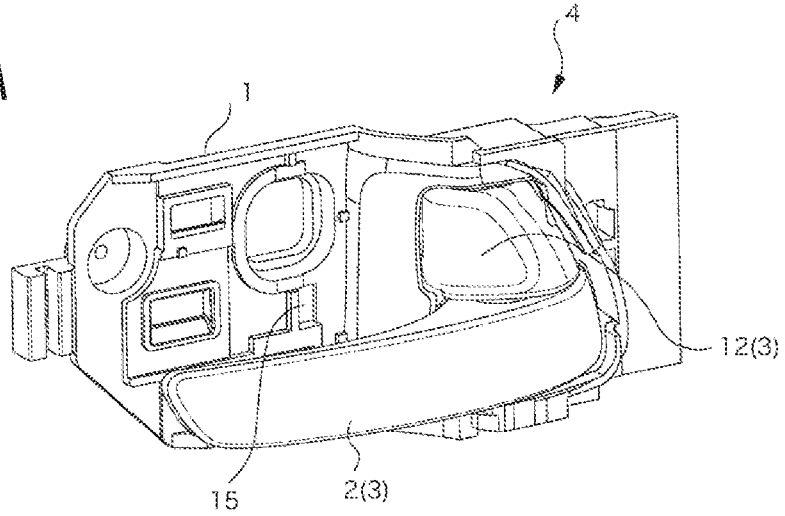
FIG. 4A is a perspective view of a handle unit as viewed from the front.
Figure 4B:
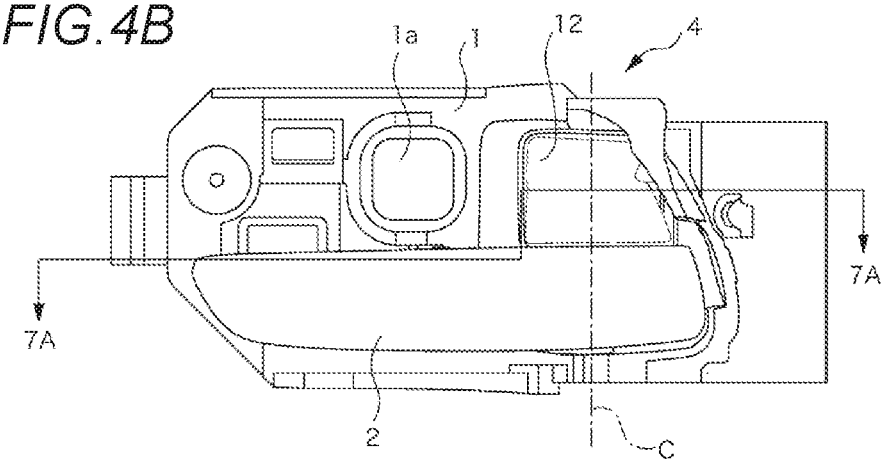
FIG. 4B is a front view of the handle unit.

The operation handle 2 and the lock knob 12 are rotated between an initial rotational position indicated by a solid line and an operation rotational position indicated by a chain line in FIGS. 2 and 3, and a biasing force toward the initial rotational position side is applied to the operation handle 2 by a torsion spring (not shown).

Figure 5A:
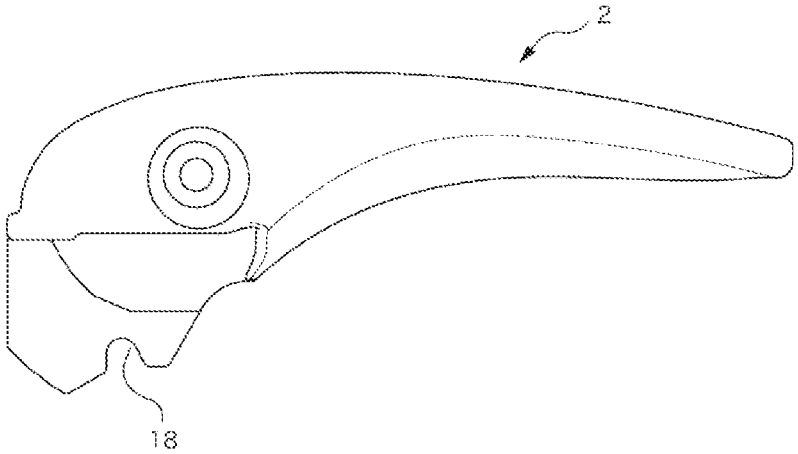
FIG. 5A is a diagram showing an operation handle of an operation member.
Figure 5B:
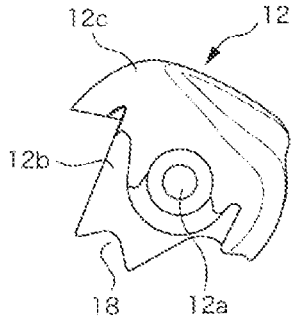
FIG. 5B is a side view of a lock knob of the operation member.

As shown in FIGS. 5A and 5B, the operation handle 2 and the lock knob 12 are each provided with a connection recess 18 to which a connecting body 11 of a cable unit 8 described later can be fitted, and the connection recesses 18 also rotate around the rotation center (C) in accordance with rotation operation to the operation handle 2 or the like.

Figure 5C:
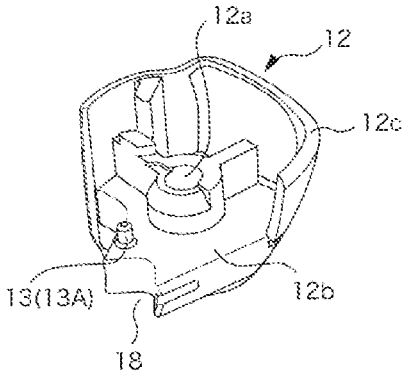
FIG. 5C is a perspective view of the lock knob of the operation member.

As shown in FIG. 5C, the lock knob 12 is formed by extending a cover 12*c* from a front peripheral edge of a hinge piece 12*b* on which a hinge hole 12*a*, through which a rotation shaft (not shown) is inserted, is opened, and the connection recess 18 is formed at one end of the hinge piece 12*b*. A drive protrusion 13A protruding in a direction parallel to the hinge hole 12*a* and constituting the drive portion 13 is provided in the vicinity of the connection recess 18.

The handle base 1 is provided with a fixing opening 1*a* to the door panel 17, and a locking opening 15 for locking the second locking portion 10 of the cable unit 8, which will be described later.

Figure 6A:
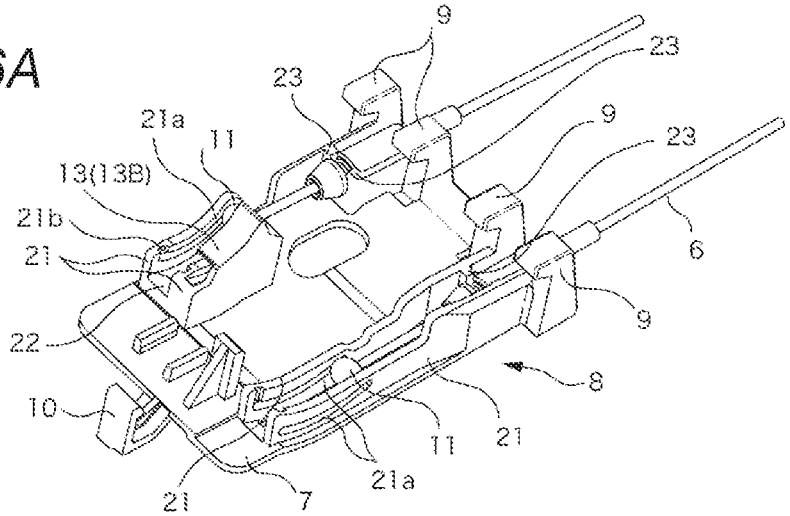
FIG. 6A is a perspective view of the cable unit as viewed from the front.
Figure 6B:
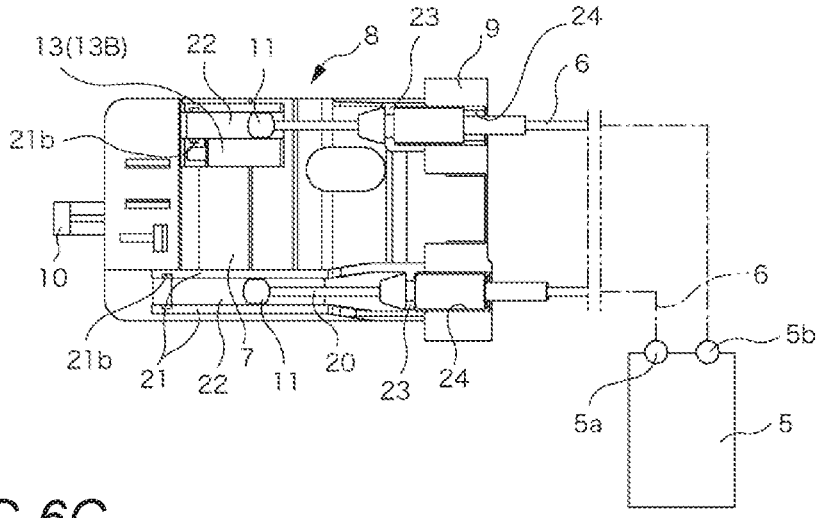
FIG. 6B is a front view of a cable unit.
Figure 6C:
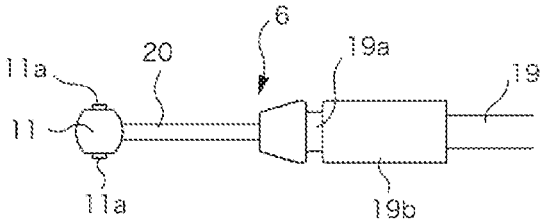
FIG. 6C is a diagram illustrating a cable device.

On the other hand, as shown in FIGS. 6A to 6C, the cable unit 8 is formed by holding one end of each cable device 6 on the cable cover 7. As shown in FIG. 6C, the cable devices 6 are formed by movably inserting inner cables 20 into outer cables 19. The connecting bodies 11 are fixed to tip ends of the inner cables 20, and end pipes 19*b* including fitting grooves 19*a* are fixed to tip ends of the outer cables 19.

The connecting bodies 11 are formed into a barrel shape having a thick central portion and having a diameter gradually reducing toward both ends, and are provided with guide projections 11*a* protruding from both end surfaces.

Figure 7A:
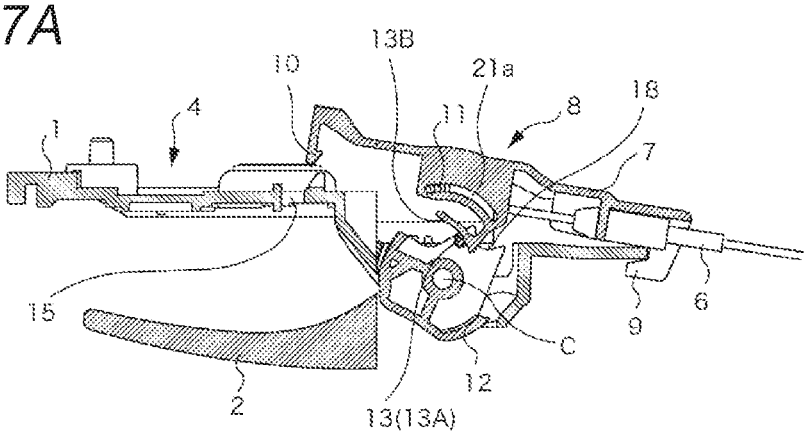
FIG. 7A is a cross-sectional view taken along a line 7A-7A of FIG. 4B showing a connection process of the cable unit in a state in which a first locking portion is locked.
Figure 7B:
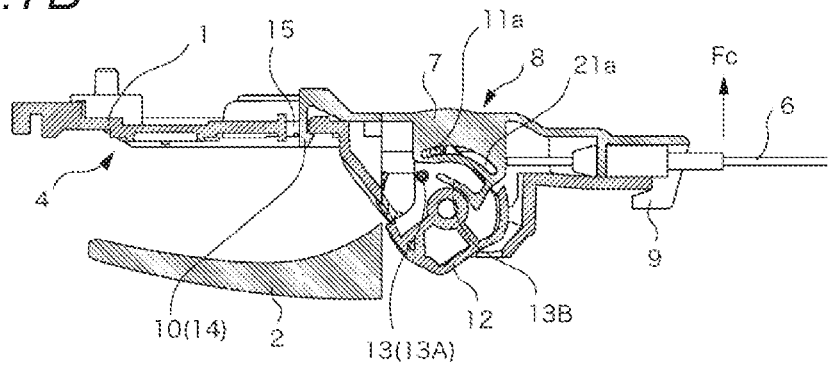
FIG. 7B is a cross-sectional view taken along a line 7A-7A of FIG. 4B showing the connection process of the cable unit in a connection completion state.

As shown in FIGS. 7A and 7B, on the cable cover 7, connecting body guide recesses 22 are formed between guide walls 21 protruding in an outside direction and opposing one another. Two sets of the connecting body guide recesses 22 are formed corresponding to the operation handle 2 and the lock knob 12 of the handle unit 4 in a state in which the cable unit 8 is connected to the handle unit 4.

The connecting body guide recesses 22 are formed to have a width dimension slightly smaller than a distance between both end surfaces of the connecting bodies 11 of the cable devices 6, and guide holes 21*a* having a long hole shape are formed on each of the guide walls 21. Each guide hole 21*a* is formed in an arc shape that matches a movement locus of the corresponding connection recess 18 of the operation handle 2 and the lock knob 12 of the handle unit 4.

As shown in FIGS. 6A to 6C, the cable cover 7 is provided with cable clip pieces 23 and cable holding portions 24 following the cable clip pieces 23 on a rear side, and the cable devices 6 are mounted at predetermined positions on the cable cover 7 by fitting front ends of the outer cables 19 into the cable holding portions 24 and inserting the cable clip pieces 23 into the fitting grooves 19*a* of the end pipes 19*b*. Guide projections 11*a* of the connecting bodies 11 of the inner cables 20 pulled out from the outer cable 19 are movably fitted into the guide holes 21*a*. In order to introduce the guide projections 11*a* of the connecting bodies 11 into the guide holes 21*a*, introduction openings 21*b* are formed on the guide walls 21.

In the present embodiment, the other end of each cable device 6 is connected to the latch device 5 in advance. In FIG. 6B, the cable device 6 corresponding to the operation handle 2 shown in the lower part is connected to a latch operation portion 5*a* of the latch device 5, and the cable device 6 corresponding to the lock knob 12 shown in the upper part is connected to a lock operation portion 5*b* of the latch device 5. In this state, the lock operation portion 5*b* is held in an unlocked state, and when an input to the latch operation portion 5*a* is given, a latch release operation is performed, the lock operation portion 5*b* transitions to a locked state, and afterward, latch release operation via operation to the latch operation portion 5*a* is prohibited.

A drive piece 13B is provided on a side of the connecting body guide recess 22 corresponding to the lock knob 12. The drive piece 13B constitutes the drive portion 13 in cooperation with the drive projection 13A of the lock knob 12, and as shown in FIGS. 6A and 6B, is provided in an eaves shape so that an edge thereof is located along a center side edge of the connecting body guide recess 22.

The second locking portion 10 and the first locking portions 9 are provided at the front and rear ends of the cable cover 7. The second locking portion 10 is formed in a hook shape by extending rearward from an inside surface of the front-end edge of the cable cover 7, and then extending to the outside, with a tip end thereof protruding rearward. The second locking portion 10 is formed to be elastically deformable, and in the present embodiment, the cable cover 7 is formed of a synthetic resin material to use elasticity thereof.

The first locking portions 9 are provided so as to protrude from a rear end edge of the cable cover 7 to the outside, and are formed with protrusions protruding forward from free ends thereof. As will be described later, the first locking portions 9 form a rotation center during connection operation to the handle unit 4, and are formed to have an appropriate volume so as not to be easily elastically deformed or broken.

Connection of the cable unit 8 formed as described above to the handle unit 4 is performed by locking the first locking portions 9 from the inside to the rear end edge of the handle base 1 and then rotating counterclockwise in FIG. 7A.

As described above, when the cable devices 6 are connected to the latch device 5 in advance, the connecting bodies 11 of the cable devices 6 connected to the latch operation portion 5*a* held in an non-input state are held at a non-input corresponding position of the latch operation portion 5*a*, which corresponds to the initial rotational position of the operation handle 2 biased by the torsion spring, and thus the connecting body 11 is fitted into the connection recess 18 of the operation handle 2 in accordance with rotation operation of the cable unit 8.

On the other hand, the lock knob 12, whose rotational position is not regulated by the handle unit 4 alone, is guided by the drive portion 13 to a fitting position with the connecting body 11 held at a position that is uniquely determined by the state of the lock operation portion 5*b*.

As described above, the drive portion 13 includes the driving protrusion 13A provided on the lock knob 12 and the driving piece 13B provided on the casing cover, and in the present embodiment in which the lock portion of the latch device 5 is held at an unlock position, when the lock knob 12 is not at the initial rotational position, during rotation operation of the cable unit 8, the drive piece 13B comes into contact with the drive projection 13A to move the lock knob 12 to the initial rotational position, and then the connecting body 11 is fitted into the connection recess 18 of the lock knob 12.

When the cable unit 8 is rotated with respect to the handle unit 4 as described above, the second locking portion 10 of the cable unit 8 is eventually locked elastically to the locking opening 15 of the handle base 1 to complete the connection operation of both. The second locking portion 10 functions as the protrusion part for mark 14 at the same time, and incompletely locked state can be visually detected.

That is, the locking opening 15 is disposed at a position visible from the surface of the handle unit 4, and as shown in FIG. 1B and FIG. 7B, since the surface of the second locking portion 10 is exposed from the locking opening 15 to the surface in the connected state, incomplete locking state can be detected only by viewing the exposure state, and detachment of the cable unit 8 due to locking failure can be completely prevented.

As described above, the inside handle device in which the cable unit 8 is connected to the handle unit 4 is fixed in a state of being sandwiched between a door trim 25 and the door panel 17 of the door, as shown in FIG. 3. In the present embodiment, fixing operation of the inside handle device is performed by incorporating the handle unit 4 into the door trim 25 in advance, and then screwing a fastening element (not shown) into a fixing portion 25*a* of the door trim 25 fitted into the fixing opening 1*a*.

In a state where the door trim 25 is fixed, a positioning projection 1*b* protruding from the inside of the handle base 1 is fitted into the positioning hole 17*a* of the door panel 17 and is positioned with respect to the door panel 17, and when the operation handle 2 or the lock knob 12 is rotated in this state, the connecting body 11 fitted to each connection recess 18 is driven, and the latch device 5 can be remotely operated.

When the inside handle device is moved in a direction away from the door panel 17 when fixed to the door panel 17, a force in an Fc direction in FIG. 7B, that is, a force in a direction in which the connecting base ends of the cable devices 6 are moved in a direction toward the door panel 17 is applied to the cable unit 8. The force Fc causes a rotational force to the cable unit 8 with the locking position of the first locking portions 9 as the rotation center, which is counter-clockwise in FIG. 7B, that is, in a direction opposite to the unlocking direction, and accordingly, the cable unit 8 is not detached even when an excessive force is applied to the cable unit 8.

In contrast, in the present embodiment in which one end of each cable device 6 is fixed to the latch device 5 in advance, upon fixing operation of the inside handle device, when the inside handle device is moved along the routing direction of the cable devices 6 or is moved in a direction approaching the door panel 17, a force in a direction detaching from the handle unit 4 is applied to the cable unit 8. However, when the inside handle device is moved in the routing direction of the cable devices 6, the cable devices 6 are routed with an appropriate extra length, and when the inside handle device is moved in the direction toward the door panel 17, the movement range is restricted by the door panel 17. Therefore, the load on the cable unit 8 is generally caused by the bending rigidity of the cable devices 6 and does not become an excessive value.

In the present embodiment, the locking force of the second locking portion 10 is set to a degree superior to a detachment force caused by the operation as described above, that is, by moving in the direction along the routing direction or in the direction toward the door panel 17 by a tensile force due to a bending rigidity of a degree of eliminating bending of the cable device 6 without further pulling.

Therefore, in the present embodiment, the movement range is not limited upon movement operation in accordance with fixing operation of the inside handle device, a load in the detaching direction of the cable unit 8 does not occur due to operation in a direction pulling the inside handle device away from the door panel, which may cause an excessive load due to carelessness of the operator, and thus excessive caution is not required for fixing operation of the inside handle device to the door panel 17, which improves workability.

Figure 8:
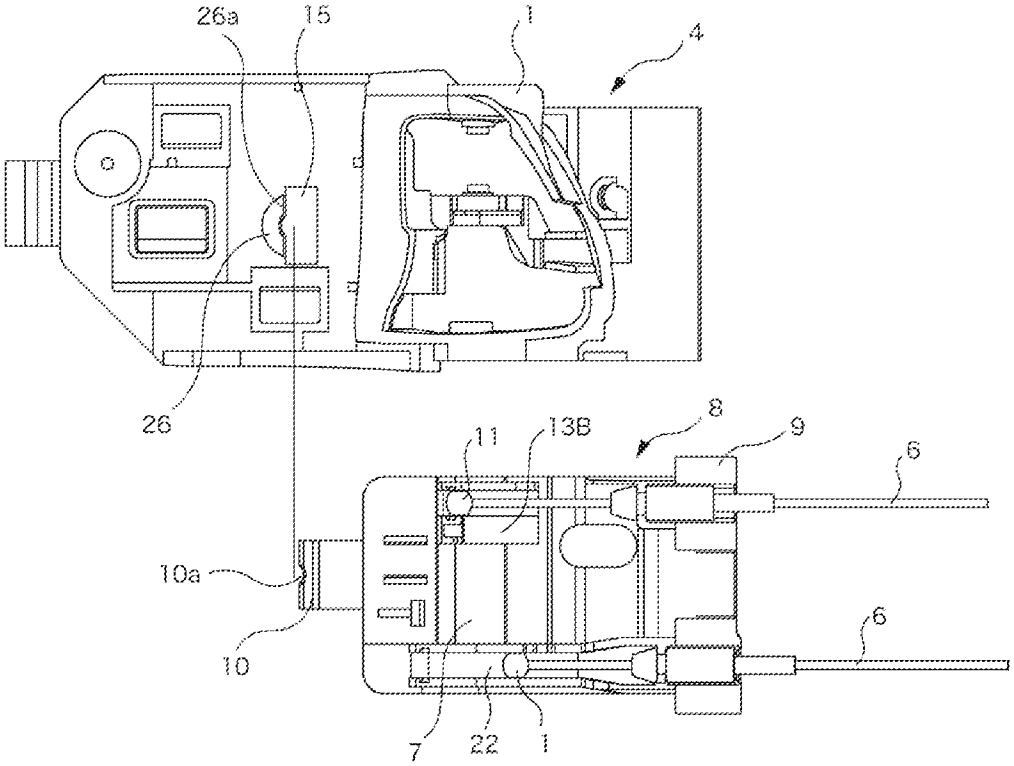
FIG. 8 illustrates another embodiment of this disclosure.
Figure 9A:
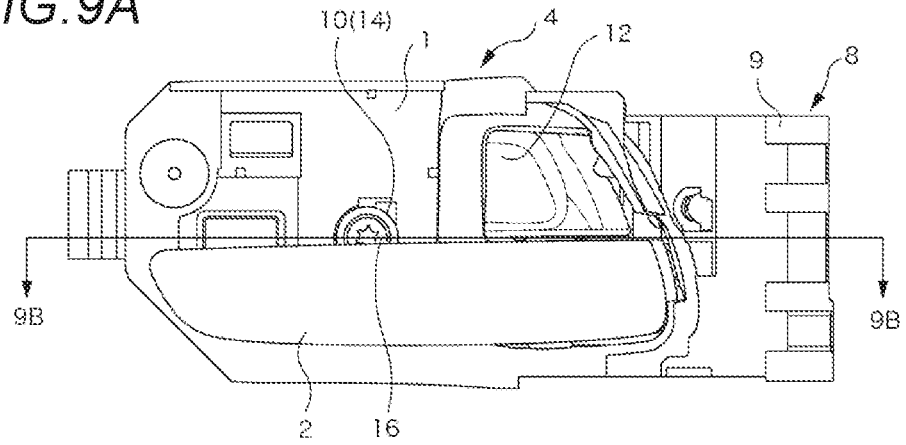
FIG. 9A is a front view of the connection completion state of FIG. 8.
Figure 9B:
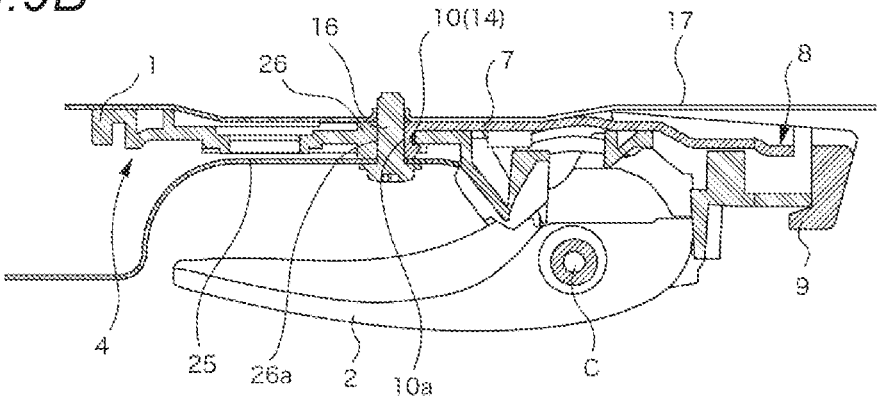
FIG. 9B is a cross-sectional view taken along a line 9B-9B of FIG. 9A.

FIGS. 8, 9A, and 9B show another embodiment of this disclosure. This embodiment shows a modification for increasing connection strength between the cable unit 8 and the handle unit 4 when fixed to the door panel 17. In the present embodiment, components that are substantially identical to those of the above-described embodiment are denoted by the same reference numerals, and description thereof is omitted.

In the present embodiment, a curved recess 10*a* is formed at the front end of the second locking portion 10 of the cable cover 7, and a screw-bearing bulging portion 26 is provided at a side edge of the locking opening 15 of the handle base 1 opposing the second locking portion 10. The screw-bearing bulging portion 26 is formed in a height dimension substantially flush with a top surface of the second locking portion 10 in a state in which the top surface is locked to the locking opening 15, and is provided with a recess 26*a* so as to oppose the recess of the second locking portion 10.

Peripheral walls of the recesses 10*a*, 26*a* of the second locking portion 10 and the screw-bearing bulging portion 26 are located on the same circumference having a diameter approximately equal to a diameter of the fastening bolt 16; and as shown in FIGS. 9A and 9B, when the inside handle device is fixed to the door panel 17 by the fastening bolt 16 inserted between the recesses 10*a* and 26*a*, the second locking portion 10 is sandwiched together with the screw-bearing bulging portion 26 by a head of the fastening bolt 16, more specifically, between the door trim 25 and the door panel 17 which are pressed by the head, and at the same time, movement of the second locking portion 10 in a forward direction of the recesses 10*a*, 26*a*, that is, in the unlocking direction with respect to the handle base 1 is restricted, and thus detachment from the handle base 1 is completely prevented thereafter.

Although the invention has been described in detail with reference to specific embodiments, it will be apparent to those skilled in the art that various changes and modifications can be made without departing from the spirit and scope of this disclosure.

This application is based on Japanese patent application 2016-217232, filed Nov. 7, 2016, the contents of which are incorporated herein by reference.

REFERENCE SIGNS LIST

1 Handle base
2 Operation handle
3 Operation member
4 Handle unit
5 Latch device
6 Cable device
7 Cable cover
8 Cable unit
9 First locking portion
10 Second locking portion
11 Connecting body
12 Lock knob
13 Drive portion
14 Protrusion part for mark
15 Locking aperture
16 Fastening bolt
17 Door panel

The invention claimed is:

1. An inside handle device of a vehicle comprising:

a handle unit; and a cable unit, wherein in the handle unit, an operation member including an operation handle is rotatably connected to a handle base, wherein the cable unit movably holds one end of a cable device configured to connect the operation member to a latch device fixed to a door on a cable cover, wherein the cable cover has a first locking portion formed at a cable introduction edge and a second locking portion formed at an opposite-end edge, wherein the first locking portion has a hook shape configured to wrap around an edge of the handle base and rotatably lock to the handle base with the opposite-end edge as a rotating end, wherein the second locking portion is elastically locked to the handle base after being rotated around the first locking portion, and wherein the operation member is locked to a connecting body formed at the one end of the cable device in a state where the cable unit is connected to the handle unit.

2. The inside handle device for the vehicle according to claim 1, wherein the operation member includes a lock knob, wherein the operation handle of the handle unit is biased toward an initial rotational position, and wherein the cable cover includes a drive piece configured to contact the lock knob and to move the lock knob to a lockable position with the connecting body when the handle unit is connected to the cable unit.

3. The inside handle device for the vehicle according to claim 1, wherein the cable cover includes a protrusion part for mark configured to be exposed to a visible position from a surface of the handle unit when connection with the handle base is completed.

4. The inside handle device for the vehicle according to claim 3, wherein the second locking portion has a hook shape configured to lock to a locking opening provided on the handle base, and wherein the hook shape is configured to be exposed from the locking opening of the handle base as the protrusion part for mark, when the cable unit is connected to the handle unit.

5. The inside handle device for the vehicle according to claim 1, wherein the inside handle device of the vehicle is fixed to a door panel by a fastening bolt, and wherein the second locking portion is restricted from moving in an unlocking direction by the fastening bolt when fixed to the door.

* * * * *